United States Patent [19]

Liebmann et al.

[11] Patent Number: 4,688,596

[45] Date of Patent: Aug. 25, 1987

[54] WALL OUTLET BOX FOR CENTRAL VACUUM CLEANING SYSTEM

[75] Inventors: John M. Liebmann, Blue Mounds; Thomas J. Anoszko, Madison, both of Wis.

[73] Assignee: Research Products Corporation, Madison, Wis.

[21] Appl. No.: 870,995

[22] Filed: Jun. 5, 1986

[51] Int. Cl.[4] ..... F16L 5/00

[52] U.S. Cl. ..... 137/360; 220/3.5; 248/27.1; 248/27.3; 248/56

[58] Field of Search ..... 137/360, 361; 220/3.3, 220/3.4, 3.5; 248/27.1, 27.3, 56

[56] References Cited

U.S. PATENT DOCUMENTS

| | | | |
|---|---|---|---|
| 989,854 | 4/1911 | Kruse | 220/3.4 |
| 2,851,286 | 9/1958 | Bishop | 137/359 |
| 3,036,814 | 5/1962 | Stevens | 137/360 |
| 3,048,875 | 8/1962 | Bottinelli et al. | 137/391 |
| 3,076,068 | 1/1963 | Racklyeft | 15/314 |
| 3,088,484 | 5/1963 | Marsh | 137/360 |
| 3,173,164 | 3/1965 | Congdon | 137/218 |
| 3,283,093 | 11/1966 | Bishop | 137/360 |
| 3,291,927 | 12/1966 | Riley, Jr. et al. | 137/360 |
| 3,297,977 | 1/1967 | Smith | 248/27.3 |
| 3,335,744 | 8/1967 | Hanford | 137/360 |
| 3,357,039 | 12/1967 | Hayward | 15/314 |
| 3,468,334 | 9/1969 | Hamrick | 137/360 |
| 3,468,448 | 9/1968 | McHollan et al. | 248/27.1 |
| 3,483,503 | 12/1969 | Paradiso | 15/314 |
| 3,565,103 | 2/1971 | Maselek | 137/360 |
| 3,570,809 | 3/1971 | Stuy | 137/360 |
| 3,628,769 | 12/1971 | Lee | 137/360 |
| 3,661,356 | 5/1972 | Tucker | 137/360 |
| 3,829,559 | 8/1974 | Fujioka | 248/27.1 |
| 4,250,540 | 2/1981 | Kristofek | 248/27.1 |
| 4,336,427 | 6/1982 | Lindsay | 137/360 |

FOREIGN PATENT DOCUMENTS

| | | | |
|---|---|---|---|
| 746123 | 12/1943 | Fed. Rep. of Germany | 220/3.5 |

OTHER PUBLICATIONS

NuTone Wall Inlet Kit Installation Instructions, NuTone Housing Group Scovill, Madison and Red Bank Roads, Cincinnati, Ohio 45227, 1/84, Part No. 58816.

*Primary Examiner*—A. Michael Chambers
*Attorney, Agent, or Firm*—Andrus, Sceales, Starke & Sawall

[57] ABSTRACT

A cutout (4) is made in a room wall (2) and flexible tubing (13) connected to a vacuum conduit (12) is pulled therethrough. A box (1) is attached to the tubing and includes a frame portion (15) for surrounding the cutout, and inwardly recessed portion (18) having side and top and bottom walls (19-22) and a back wall (23), and outwardly and inwardly extending annular connector flanges (25, 26) for connecting to the vacuum wand and the conduit flexible tubing. After the conduit tubing and box are connected, the box is pushed inwardly so that its recessed portion extends through the cutout into the wall. A slot (29, 30) is provided in each vertical sidewall of the box with the slot extending into the back wall so that it is generally L-shaped in section. A generally Z-shaped clip (33) having a long leg (35) and short leg (34) joined by a web (36) is provided for each slot. The short leg is inserted through a slot so that the short leg engages the rear wall face, the web extends forwardly along the side wall of the recess, and the long leg extends across the recess toward the outwardly extending annular flange. The clips make it possible to accommodate various wall thicknesses and cannot fall into the wall during installation. Subsequently, screws are utilized to fixedly mount the box to the wall. A door (27) is pivotally mounted to the box to cover the interior thereof when the box is not in use. The door seals against the outer edge of the outwardly extending flange to prevent air leakage when the system is being used in other rooms. The door is formed (44) for easy engagement and manipulation by the user's hose.

10 Claims, 10 Drawing Figures

FIG. 1
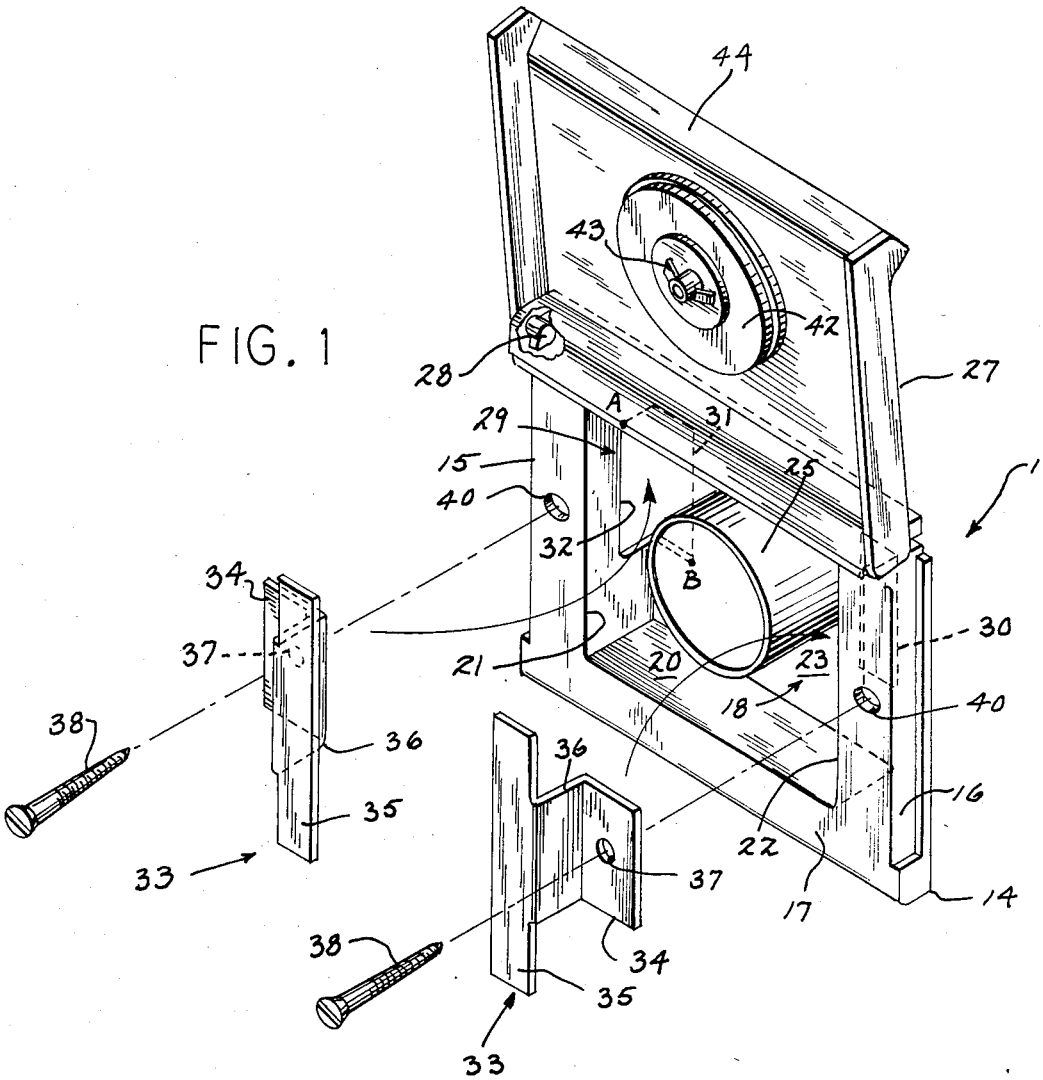
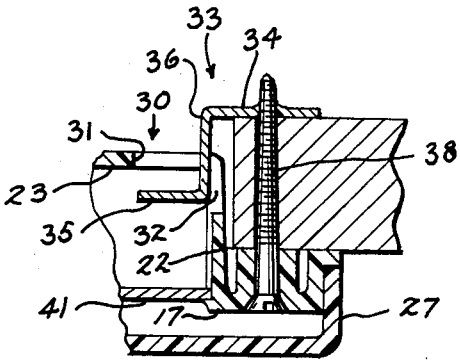
FIG. 9
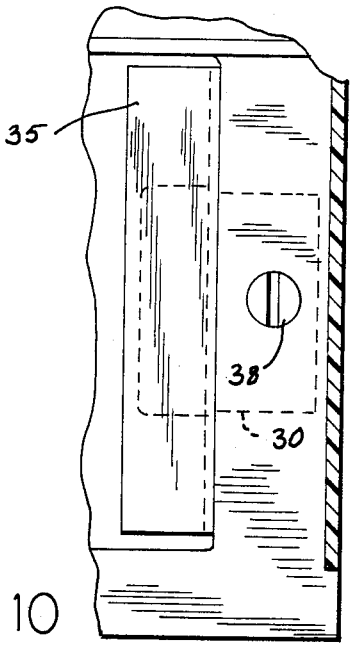
FIG. 10

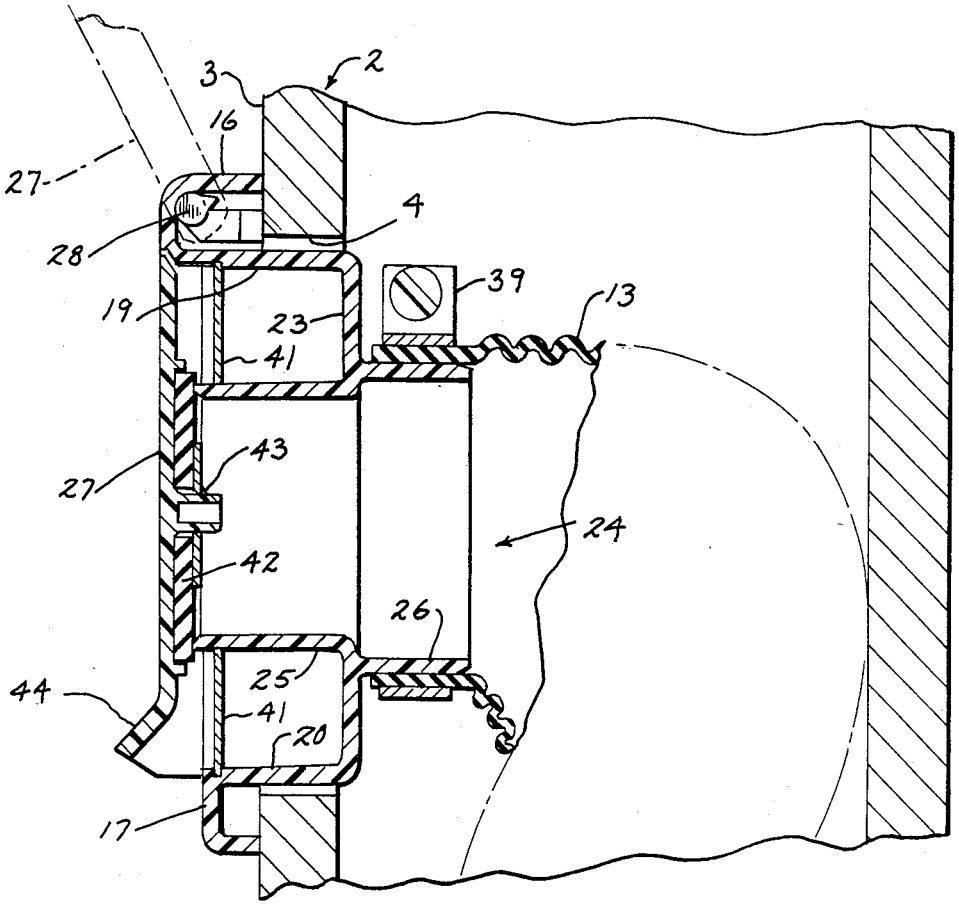
FIG. 7
FIG. 8
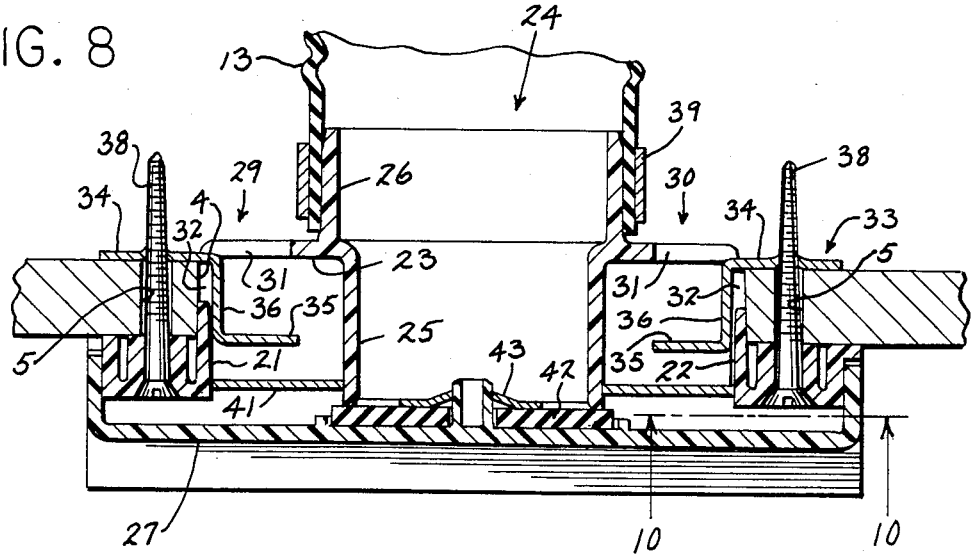

WALL OUTLET BOX FOR CENTRAL VACUUM CLEANING SYSTEM

BACKGROUND AND SUMMARY OF THE INVENTION

This invention relates to a wall outlet box for central vacuum cleaning systems and the like.

In recent years, central vacuum cleaning systems for domestic and other uses have become more and more desirable. These systems have included a motorized power unit which is usually installed in a central location, such as a basement. A plurality of conduits are connected to a main trunk line which exits the power unit and extends up through the building walls to each room where vacuuming is desired. An outlet box is disposed in the wall of each of the desired rooms and a conduit is connected thereto. The user merely attaches a suitable hose to the box, which connects the hose to the central power unit. The same hose may be utilized in all of the rooms, if desired. The power unit may be controlled in any suitable manner, such as by wall switches or radio control.

Many prior patents illustrate various types of wall outlet boxes and the like for central vacuum systems. See for example, U.S. Pat. Nos. 2,851,268, 3,048,875 and 3,173,164. The constructions of the various patents tend to be complex in nature, and therefore expensive and difficult to manufacture, install and maintain. The January 1984 installation instructions for the wall inlet kit—Scovill Model 326—illustrates another known device which, in some respects, is an improvement of the disclosures of the prior patents. In the Model 326, the conduit in the wall is brought forward through the cutout for assembly with the box elements, and the device can be used with walls of varying thicknesses. However, the device is still complex.

It is an object of the present invention to provide a wall outlet box for central vacuum cleaning systems which is improved and simplified over the prior disclosed and known devices. It is a further object to provide such a device that can be easily assembled in just a few steps.

In accordance with the various aspects of the invention, a cutout is made in a room wall and flexible tubing connected to the vacuum conduit is pulled therethrough, somewhat similarly to the Scovill Model 326 device. A box is provided which is attached to the tubing and which includes a frame portion for surrounding the cutout, an inwardly recessed portion of smaller dimensions than the cutout and having side walls with top and bottom walls and a back wall, and outwardly and inwardly extending annular connector flanges for connecting to the vacuum wand and the conduit flexible tubing respectively. After the conduit tubing and box are connected, the box is pushed inwardly so that its recessed portion extends through the cutout into the wall. A slot is provided in each vertical side wall of the box with the slot extending into the back wall so that it is generally L-shaped in section. A generally Z-shaped clip having a long leg and parallel short leg joined by a transverse web is provided for each slot. The short leg is inserted through a slot so that the short leg engages the rear wall face, the web extends forwardly along the side wall of the recess, and the long leg extends across the recess toward the outwardly extending annular flange. The clips make it possible to accommodate various wall thicknesses. Furthermore, the construction is such that the clips cannot fall into the wall during installation. Subsequently, screws are inserted through the frame portion, building wall and short inner clip legs to fixedly mount the box to the wall. A door is pivotally mounted to the box to cover the interior thereof when the box is not in use. The door seals against the outer edge of the outwardly extending flange to prevent air leakage when the system is being used in other rooms. Furthermore, the door is formed for easy engagement and manipulation by the user's hose.

BRIEF DESCRIPTION OF THE DRAWINGS

The accompanying drawings illustrate the best mode presently contemplated by the inventors for carrying out the invention.

In the drawings

FIG. 1 is an exploded perspective view of the wall outlet box, with cover up, and showing some of the aspects of the invention;

FIG. 7 is an enlarged vertical section showing the box fully mounted to the wall;

FIG. 8 is an enlarged horizontal section showing the fully mounted box;

FIG. 9 is a fragmentary view showing accommodation to a wall of greater thickness; and FIG. 10 is a view taken on line 10—10 of FIG. 8.

DESCRIPTION OF THE PREFERRED EMBODIMENT

Figure 2:
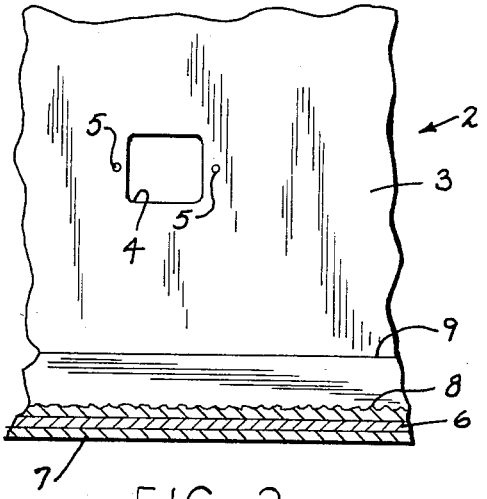
FIG. 2 is a schematic showing of the cutout formed in the room wall.

As shown in the drawings, the various aspects of the invention are directed to an outlet box 1 for mounting to the wall 2 of a building and for connection to a central vacuum cleaning system of any suitable well-known type, not shown, which is disposed at a remote location. Wall 2 is at least partially hollow and includes a front facing 3 having a cutout 4 and screwholes 5 therein. Wall 2 is supported on a finish floor 6 which in turn is mounted to a subfloor 7 and has carpeting 8 and a baseboard 9 thereon. A sole plate 10 is disposed with the base of wall 2 and has an opening 11 therein for receipt therethrough of a conduit 12 of plastic or the like. The remote end of conduit 12 is connected to the central vacuum system, while the closely adjacent end has mounted thereon, as by a suitable adhesive, a flexible hose 13.

Turning now especially to FIGS. 1, 7 and 8, outlet box 1 comprises a generally rectangular unitary housing 14 of molded plastic or the like and having a peripheral frame portion 15 which is adapted to ultimately be mounted against wall 2. Frame portion 15 includes side walls 16 and generally planular front walls 17. Box 1 is provided with a central recess 18 which extends inwardly from walls 17, and which is defined by top and bottom walls 19, 20 respectively, side walls 21, 22 and a back or rear wall 23. The walls of recess 18 are of slightly less dimension than the dimensions of cutout 4, for purposes to be described. Rear wall 23 is provided with a central circular opening 24. A first annular flange 25 extends outwardly or forwardly from the edge of opening 24, while a second annular flange 26 extends inwardly or rearwardly from the edge of opening 24, for purposes to be described. As shown, flanges 25 and 26 differ slightly in diameter. In addition, a cover 27 is hingedly mounted to box 1 in any suitable manner, such as by stub shafts 28 on the cover which extend into housing 14.

A generally L-shaped vertical slot 29, 30 is disposed at the midportion of each of the two rear corners of recess 18. The slots include a portion 31 which is disposed in rear wall 23, with the slots also including a portion 32 disposed in the respective side walls 21, 22. Slots 29 and 30 are adapted to cooperate with means for mounting box 1 to front facing 3 of wall 2. For this purpose, a clip 33 is adapted to extend within the respective slots and engage the back wall of wall facing portion 3 and the respective recess side walls 21 and 22. Each clip 33 is generally Z-shaped in section and comprises a short leg 34, a long leg 35 spaced from and generally parallel to leg 34, and a short transverse web 36 joining the leg edges. Leg 34 and web 36 are disposed intermediately of leg 35 and are of about the same length, with the end portions of long leg 35 extending therebeyond. Leg 34 and web 36 are also about as long as the height of slots 29 and 30. An opening 37 is disposed in each short leg 34 for receiving mounting screws 38, as will be described.

Figure 3:
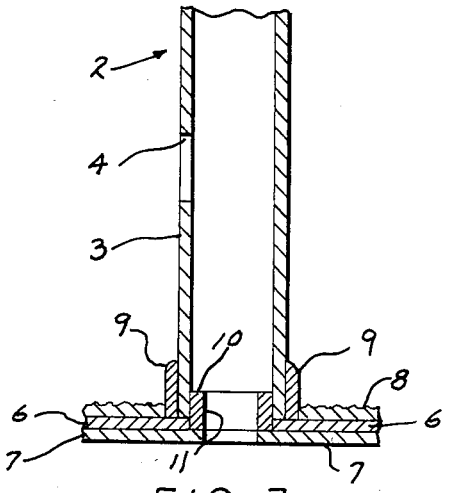
FIG. 3 is a vertical section of the wall, taken through the cutout.
Figure 4:
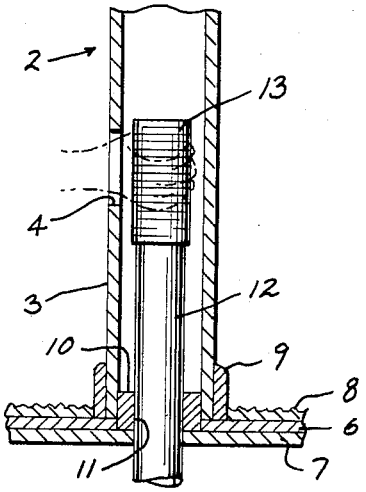
FIG. 4 is a view similar to FIG. 3, illustrating insertion of the vacuum conduit into the wall and pulling the conduit forwardly through the cutout.
Figure 5:
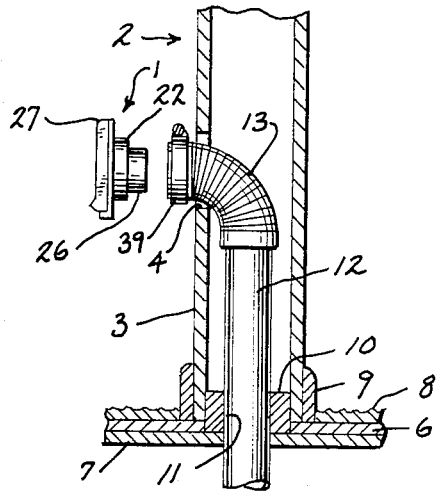
FIG. 5 illstrates assembling the inwardly extending box flange to the conduit.

FIGS. 2–6 illustrate the method of assembling and installing outlet box 1. Referring first to FIG. 2, rectangular cutout 4 and mounting holes 5 are first formed in front facing 3 of wall 2. As shown in FIG. 3, opening 11 is formed in sole plate 10. Conduit 12 with flexible hose 13 attached at its end is then passes up through opening 11 and into wall 2 so that hose 13 is right behind cutout 4 where it can be seen, as per FIG. 4. Hose 13 is then pulled forwardly through cutout 4. All subsequent operations take place from the front of wall 2. A suitable ring-clamp 39 is mounted to the end of hose 13, the second annular flange 26 is inserted into hose 13 and the clamp tightened thereonto. See FIG. 6. Box 1 is then pushed into the wall so that the side walls of recess 18 are inserted through cutout 4. This is easily done because of the aforesaid smaller dimensions of the recess compared to the cutout dimensions. At this point, box 1 is ready for final assembly to wall 2.

Figure 6:
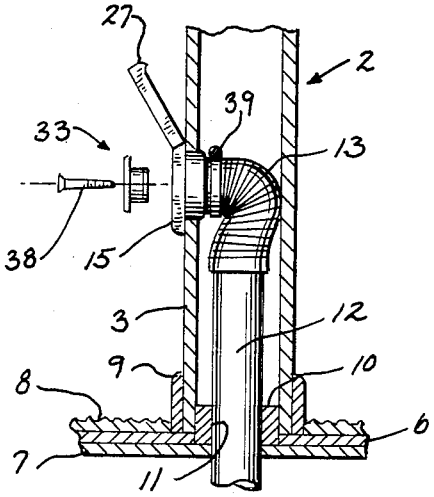
FIG. 6 illstrates placing the box against the wall and assembling a clip and screw thereto.

Referring to FIGS. 1, 6 and 8, a clip 33 is inserted from the front and into recess 18. Short leg 34 and web 26 are then inserted rearwardly and through a slot, such as 29, and the clip manipulated and pushed sideways so that its short leg 34 engages the rear face of wall facing 3 and its web 36 extends forwardly along recess side wall 21. As shown in FIG. 8, long leg 35 will be disposed forwardly of and parallel to rear wall 23. A screw 38 is then mounted through a suitable opening 40 in housing frame 15, passes through wall opening 5 and hence through opening 37 in clip short leg 34, and is tightened in place to sandwich wall 2 between the housing and clip. The other clip 33 is similarly attached and mounted.

The construction is such that the fore-to-aft depth of clip webs 36 determines the range of depth or thickness of wall that can be accommodated. The clips thus automatically adjust for different wall depths. As the wall gets thicker, as by comparing FIG. 9 with FIG. 8, web 36 is shifted rearwardly in its slot, and long leg 35 moves closer to rear housing wall 23. The thickness of wall that can be handled by clips of a given size is thus any thickness less than the said width or depth of web 36.

Furthermore, the relative constructions of slots 29, 30 and clips 33 is such that when the clips are inserted into the slots, the clips cannot accidentally fall through the slots and down into the depths of wall 2, where the clips could not be retrieved. Note FIG. 10 which illustrates that the ends of long leg 35 are such as to substantially exceed the height of slot 30. The same is true relative to slot 29. Furthermore, the long leg 36 is substantially longer than the diagonal corner-to-corner distance of a given slot. (From A to B of FIG. 1) If the clips should be turned on their side, in a horizontal direction compared to the vertical showing of FIG. 1, they still cannot be lost through a corner slot. This is accomplished because the sum of the widths of short and long legs 34 and 35 is also greater than the said corner-to-corner distance.

Once box 1 is mounted to wall 2, a rectangular plate 41 may be mounted within recess 18 forwardly of clips 33 for protective purposes. Furthermore, cover 27 may then be lowered until the device is to be used. As shown in FIGS. 1, 7 and 8, a disc-shaped gasket 42 may be mounted to the inside of cover 27 by means of a suitable spring retainer 43. When cover 27 is closed, gasket 42 seals against the exposed front eges of front flange 25. This prevents air leakage through the box when the vacuum cleaning system is being utilized in other areas.

If desired, a forwardly extending lip 44 may form the lower edge of cover 27, remote from its pivotal mounting. Lip 44 has the advantage of being easily engageable by the fingers or even a vacuum hose inlet, not shown, so that the cover may be readily opened for attachment of a wand to flange 25.

Various modes of carrying out the invention are contemplated as being within the scope of the following claims particularly pointing out and distinctly claiming the subject matter which is regarded as the invention.

We claim:

1. A wall outlet box for central vacuum cleaning systems and the like and with said box being mountable to a wall (3), said box comprising, in combination:

(a) a generally rectangular unitary housing (14) forming an outwardly facing peripheral frame (15), (b) a recess (18) extending inwardly from said frame and with said recess being defined by at least a pair of side walls (21, 22) and a rear wall (23) forming rear corners with the latter, (c) said rear wall (23) having an opening (24) therein, (d) means (26) extending rearwardly from said opening for connection to a vacuum conduit (12, 13), (e) means (25) extending forwardly from said opening for connection to a user's hose inlet or the like, (f) a generally L-shaped slot (29, 30) formed at each said rear corner of said recess (18) and with said slot including a portion in said rear wall (23) and in one of said side walls (21, 22), (g) clip means (33) adapted to partially extend rearwardly and be rearwardly insertable through each said slot (29, 30) and engage the back side of the said first-named wall (3) to which said box is to be mounted, (h) and means (38) for connecting said housing (14) with said clip means (33) for sandwiching a said first-named wall (3) therebetween.

2. The combination of claim 1 in which said clip means (33) is automatically adjustable for different wall depths.

3. The combination of claim 1 in which said clip means (33) is generally Z-shaped and comprises:

(a) a first leg (35), (b) a second leg (34) generally parallel to said first leg, (c) and a web (36) disposed transversely of and joining said first and second legs, (d) the construction being such that when said box is installed in a cutout (4) in a said first-named wall (3):

(1) said second leg (34) engages the rear of said first-named wall (3), (2) said web (36) extends through said slot (29, 30) and engages a said recess side wall (21, 22), (3) and said first leg (35) extends generally parallel to said rear wall (23) within said recess.

4. The combination of claim 3 in which:

(a) said clip means (33) is automatically adjustable for different wall depths, (b) the width of said web (36) forming means determining the maximum wall thickness which can accommodate said box.

5. The combination of claim 3 or 4 in which:

(a) said first leg (35) is longer than said second leg (34) and said web (36), (b) and said second leg (34) and web (36) are shorter than the height of said slot (29, 30),

6. The combination of claim 5 in which said first leg (35) is longer than the height of said slot (29, 30).

7. The combination of claim 6 in which said first leg (35) is longer than the diagonal distance (A–B) between slot corners.

8. The combination of claim 7 in which the sum of the widths of said first leg (35) and said second leg (34) is greater than the said diagonal distance (A–B) between slot corners.

9. The combination of claim 3 or 4 in which said connecting means (38) joins said housing frame (15) and said second clip leg (34).

10. The combination of claim 1, 3 or 4 which includes:

(a) cover means (27) mounted to said housing (14) for pivotal movement between an open and closed position, (b) and means (48) engageable by a user's hose inlet or the like for lifting said cover means (27) from its closed position.

* * * * *